US005539672A

United States Patent [19]

Mullin et al.

[11] Patent Number: 5,539,672

[45] Date of Patent: Jul. 23, 1996

[54] MICROPROCESSOR-BASED TEMPERATURE CONTROL CIRCUIT

[75] Inventors: Paul S. Mullin, Kettering; Raymond M. Lepore, Troy, both of Ohio

[73] Assignee: Hobart Corporation, Troy, Ohio

[21] Appl. No.: 166,246

[22] Filed: Dec. 13, 1993

[51] Int. Cl.[6] ..... F23Q 9/08; H03B 5/12

[52] U.S. Cl. ..... 364/557; 331/185; 331/117 FE; 331/66; 431/80

[58] Field of Search ..... 364/557; 323/907; 363/56, 58, 21, 95, 65; 331/117 R, 66, 185, 117 FE; 307/490, 491, 497; 431/80

[56] References Cited

U.S. PATENT DOCUMENTS

| | | | |
|---|---|---|---|
| 4,669,049 | 5/1987 | Kosednar et al. | 364/557 |
| 4,696,639 | 9/1987 | Bohan, Jr. . | |
| 4,718,776 | 1/1988 | Gilland et al. | 374/170 |
| 4,734,658 | 3/1988 | Bohan, Jr. | 331/117 R |
| 4,734,871 | 3/1988 | Tsunoda et al. | 364/557 |
| 4,770,629 | 9/1988 | Bohan, Jr. . | |
| 4,797,803 | 1/1989 | Carroll | 363/95 |
| 5,019,717 | 5/1991 | McCurry et al. | 363/65 |
| 5,095,453 | 3/1992 | Pierson et al. | 364/571.01 |
| 5,186,097 | 2/1993 | Vaseloff et al. | 364/557 X |
| 5,282,122 | 1/1994 | Summer | 363/21 |

FOREIGN PATENT DOCUMENTS

| | | |
|---|---|---|
| 0025725 | 8/1981 | European Pat. Off. . |
| 0065201 | 2/1984 | European Pat. Off. . |
| 0130411 | 1/1985 | European Pat. Off. . |
| 3420033 | 12/1985 | Germany . |

*Primary Examiner*—Ellis B. Ramirez
*Assistant Examiner*—M. Kemper
*Attorney, Agent, or Firm*—Thompson Hine & Flory

[57] ABSTRACT

A temperature control circuit which is capable of operating a microprocessor on a very low voltage source. The temperature control circuit uses a pair of field effect transistors and a zener diode in an oscillator circuit to amplify the source voltage. A microprocessor is supplied by the amplified source voltage, and is connected through a transistor to a temperature sensing portion of the circuit. The microprocessor uses the transistor to turn the power to the temperature sensing circuit portion off between temperature samples. By turning the temperature sensing circuit power off between samples, the average power drain by the control circuit is an amount that can be met by the amplified voltage from the low voltage source.

12 Claims, 2 Drawing Sheets

MICROPROCESSOR-BASED TEMPERATURE CONTROL CIRCUIT

BACKGROUND OF THE INVENTION

The present invention relates to temperature control circuits, and more particularly, to a microprocessor-based temperature control circuit that can be used with a low voltage power supply such as a thermopile.

A typical low voltage power supply is disclosed in Bohan, Jr., U.S. Pat. No. 4,734,658. This type of power supply contains an oscillator circuit for stepping-up a very low voltage supplied by a thermoelectric generator means or thermopile. The voltage output from the oscillator circuit can be rectified and regulated for use in energizing very low power solid state temperature control components.

However, this type of power supply circuit has limited output current capability, and therefore, is unable to power a microprocessor-based temperature control circuit. It is desirable to use a microprocessor in a temperature control system in order to acquire more accurate temperature readings and a more rapid response to a temperature change.

Accordingly, there is a need for a temperature control circuit that incorporates a microprocessor, yet can be powered by a low voltage source such as a thermopile.

SUMMARY OF THE INVENTION

The present invention is directed towards a microprocessor-based temperature control circuit which is powered by a low voltage source such as a thermopile, and which is capable of reliably operating at input voltages as low as 150 millivolts. The temperature control circuit is capable of running a microprocessor on such a low voltage source, by using an efficient power supply circuit to transform millivolt, high current input into a voltage output of 4–6 volts and a current output of less than 750 microamps, and by using the microprocessor in conjunction with a field effect transistor to turn the temperature sensing portion of the circuit off between temperature samples to conserve power from the supply.

In the temperature control circuit, the microprocessor can be programmed to take a temperature sample multiple times per second. During a temperature sample, the microprocessor turns on the power to the temperature sensing portion of the circuit through the transistor. A temperature signal from a temperature sensor, such as a thermistor, is then amplified by the temperature sensing portion of the circuit and input to the microprocessor. After receipt of the amplified temperature signal, the microprocessor discontinues the signal to the transistor, thereby switching off the power to the temperature sensing portion of the circuit. The load drain on the power supply is high when the temperature sensing portion of the circuit is powered on, but low when the power to the temperature sensing portion is turned off. Using the microprocessor to turn the power to the temperature sensing portion of the circuit off between temperature samples, enables the power drain by the temperature control circuit to average out to an amount that can be delivered by the low voltage power supply.

Accordingly, it is an object of the present invention to provide a temperature control circuit having a low voltage source of direct current, an oscillator for amplifying the voltage from the low voltage source to produce a stepped up and regulated direct current potential, a microprocessor and a temperature sensing circuit portion powered by the regulated direct current potential, the temperature sensing circuit including, means for measuring a temperature and sending a signal to the microprocessor which corresponds to the measured temperature, and switching means for turning the power to the temperature sensing circuit on and off in response to a signal from the microprocessor, the temperature sensing circuit portion being powered on when a temperature measurement is being taken, and powered off between temperature measurements.

Other objects and advantages of the present invention will be apparent from the following description, the accompanying drawings and the appended claims.

DETAILED DESCRIPTION

Figure 1:
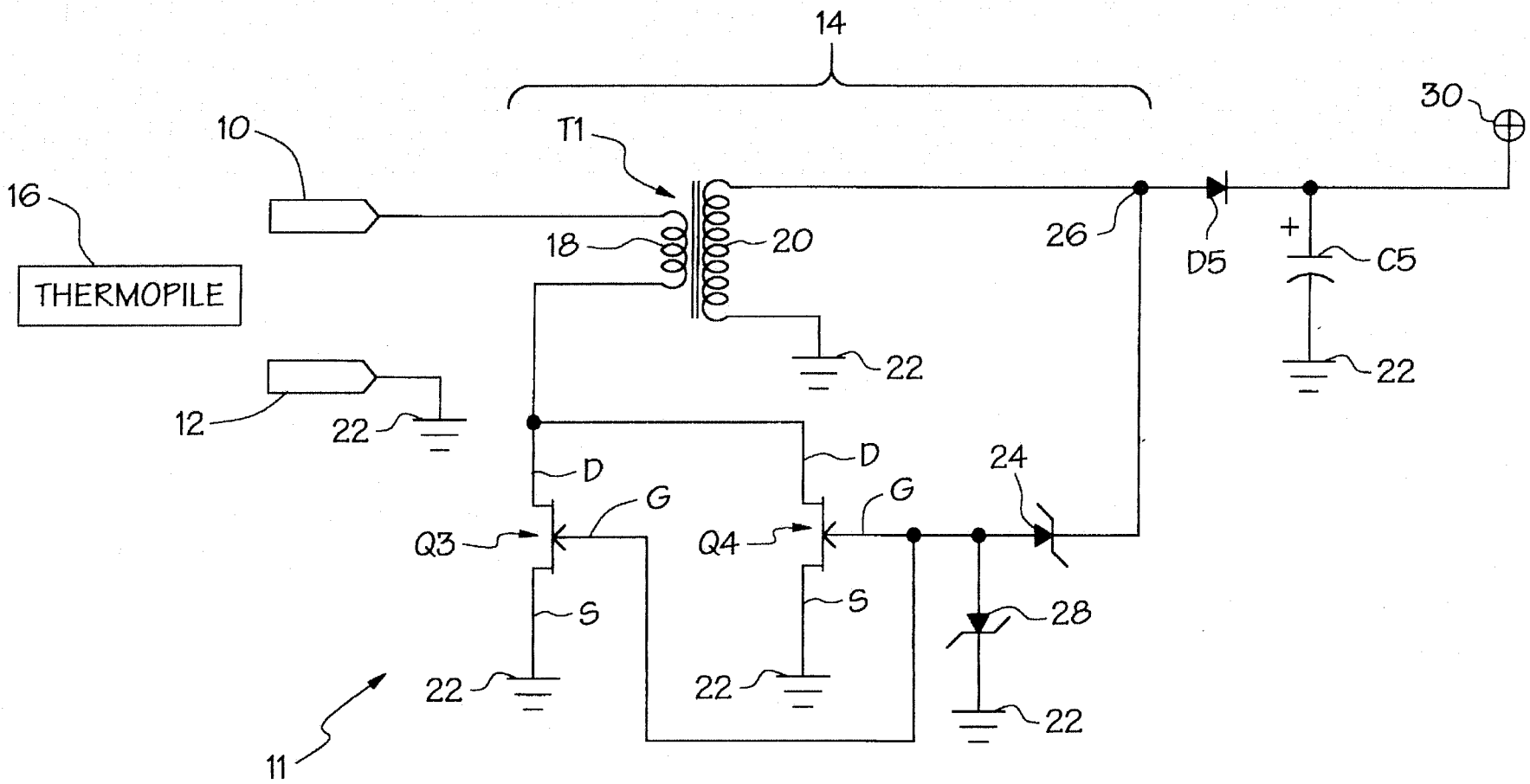
FIG. 1 is a schematic of the power supply circuit.

As shown in FIG. 1, the power supply portion of the control circuit, designated generally as 11, includes a pair of terminals 10, 12 which connect an oscillator circuit 14 to a source of direct current voltage 16. As an example, the direct current voltage source could be a pilot flame impinging on a thermoelectric generator means such as a thermopile. The terminals 10, 12 supply the direct current voltage to a primary winding 18 of transformer T1, which is inductively coupled to a secondary winding 20. In the preferred embodiment, the transformer T1 has a high-turns ratio, such as 50:1, and a ferromagnetic core to produce a high mutual inductance between the windings. In FIG. 1, the magnetic phasing of the transformer T1 is shown in conventional dot format.

The primary winding 18 of transformer T1 is connected to a pair of field effect transistors Q3 and Q4. The transistors Q3 and Q4 each have a drain D, a source S, and a gate G. The drain D of each transistor is connected to the primary transformer winding 18, while the source S of each transistor is connected to a common ground connection 22 for the overall control circuit.

Connected to the gates G of the field effect transistors Q3 and Q4, are zener diodes 24 and 28. The zener diode 24 is also connected at node 26 to the secondary winding 20 of the transformer T1, and zener diode 28 is also connected to the common ground connection 22.

The transformer secondary winding 20 is also connected through node 26 to a diode D5, which is in turn connected to a capacitor C5 at node 30. The diode D5 rectifies the voltage output from the oscillator circuit 14. Capacitor C5 is a large capacitor, such as 68 microfarads, for storing the rectified and regulated voltage from the oscillator circuit 14. Capacitor C5 stores voltage when the load drain on the power supply 11 is low, and discharges when the load drain on the power supply 11 is high. A second side of the capacitor C5 is connected to the secondary winding 20, field effect transistors Q3 and Q4, and zener diode 28 through the common ground connection 22.

Node 30 is the voltage output terminal for the power supply portion 11 of the temperature control circuit. The remainder of the temperature control circuit, to be described below, is energized by the regulated direct current voltage output at node 30.

Figure 2:
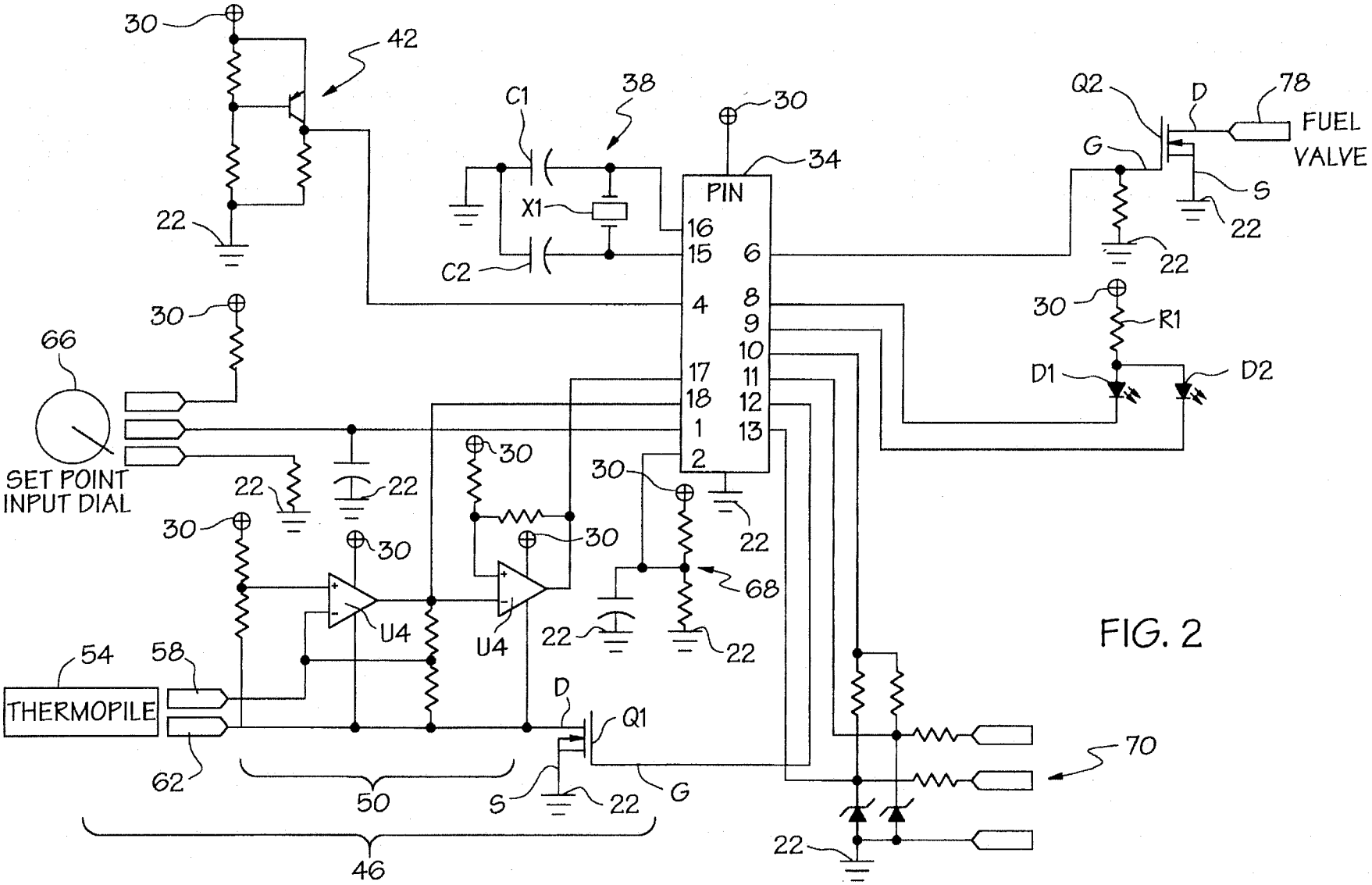
FIG. 2 is a schematic of the temperature sensing portion of the control circuit, showing the microprocessor and voltage-controlled current switch.

As shown in FIG. 2, a microprocessor 34 is supplied by the power supply 11 through node 30, and is connected to the common ground connection 22. In the preferred embodiment, the microprocessor 34 is a PIC16LC71 model, standard low power microprocessor. This particular microprocessor has been disclosed by way of example only, and the present invention could be utilized with any low power microprocessor. Preferred microprocessors are capable of operating on 150 microamps or less. The microprocessor 34 is the control means for the temperature control circuit.

As shown in FIG. 2, a standard clocking means, designated generally as 38, is connected to the microprocessor 34 at pins 15 and 16. The clocking means 38 establishes the timing for the sampling and operations of the microprocessor 34. In the preferred embodiment, the microprocessor timing has been set to a frequency of 32 kHz through crystal X1. The capacitors C1 and C2 stabilize the crystal X1.

A reset circuit, designated generally as 42, is connected to the microprocessor 34 at pin 4. The reset circuit 42 detects and resets the microprocessor 34 in the event of a low voltage condition in the control circuit.

The temperature sensing portion of the control circuit, designated generally as 46, includes an analog-to-digital converter which is internal to the microprocessor 34, and external circuitry, designated generally as 50, connected to the microprocessor 34 at pins 17 and 18. Microprocessor input pins 1, 2, 17, and 18 are connected to the internal analog to digital converter. It is a standard feature in the PIC16LC71 microprocessor, shown in the preferred embodiment, for the software to have the capability of shutting down the internal analog to digital converter when it is not in use in order to save power.

The temperature sensing circuit 46 also includes a temperature sensor, such as a thermistor 54. The sensor or thermistor 54 can be placed in a location remote from the control circuit where a temperature is to be measured, and connected to the control circuit through terminals 58, 62.

The temperature sensing circuit 46 also includes a pair of operational amplifiers, designated U4, and resistors. The operational amplifiers U4 amplify the temperature signal from the thermistor 54 before the signal is input to the microprocessor 34, to improve the accuracy of the temperature measurement.

The temperature sensing circuit 46 also includes a field effect transistor Q1. The drain D of transistor Q1 is connected to terminal 62 of the thermistor 54 and the ground connections for the Op-Amps, while the gate G of the transistor Q1 is connected to the microprocessor 34 at pin 12. The source S of the transistor Q1 is connected to the common ground connection 22 for the circuit. The field effect transistor Q1 functions as a switch, and is the means through which the microprocessor 34 turns on and off the power to the temperature sensing circuit 46.

A set point input dial, designated generally as 66, is connected to the internal analog to digital converter of the microprocessor 34 through pin 1. In a preferred embodiment, the temperature control circuit is used in commercial cooking equipment such as fryers, ranges and ovens. In this embodiment, the set point input dial 66 is used to set the desired operating temperature for the cooking equipment. The software in the microprocessor 34 is programmed to check the set point input dial 66 periodically to determine the desired operating temperature and to operate a fuel valve 78. In the preferred embodiment, the microprocessor 34 is programmed to check the set point input dial 66 approximately every 5 seconds.

A series of auxiliary switch connections, designated generally as 70, are connected to the microprocessor 34 at pins 10, 11 and 13. These switch connections can be utilized for operator input, and can be adapted to a particular application of the temperature control circuit.

A voltage reference 68, consisting of resistors R14, R15 and a capacitor C3, is connected to the microprocessor internal analog to digital converter at pin 2. The voltage reference 68 sets the upper limit for the microprocessor 34 in determining what is a normal temperature measurement from the thermistor 54.

LED indicators, consisting of diodes D1, D2, are connected by means of a resistor R1 to the power supply node 30. In the preferred embodiment, the LED indicators flash periodically upon receipt of a signal from the microprocessor 34. The microprocessor 34 sends a signal to flash the LED indicators when the microprocessor software senses a problem in the control circuit such as an extremely high or low temperature.

A fuel valve 78 is connected by means of a field effect transistor Q2, to pin 6 of the microprocessor 34. The drain D of the field effect transistor Q2 is connected to the fuel valve 78, while the gate G of the field effect transistor Q2 is connected to pin 6 of the microprocessor 34. The source S of the field effect transistor Q2 is connected to the common ground connection 22. The field effect transistor Q2 functions as a switch to turn on and off the fuel valve 78 in response to a signal from the microprocessor 34. When the field effect transistor Q2 is conductive, the fuel valve 78 is opened, to supply fuel to the main burner of the cooking device.

Operation

The operation of the preferred embodiment of the temperature control circuit is as follows. In the power supply 11, the oscillator circuit 14 forms a loop that is electrically unstable. When fed a low input D.C. voltage at terminals 10 and 12 from a thermoelectric generator or thermopile 16, the loop oscillates producing large voltage swings at node 26. These voltage swings are rectified by diode D5 and filtered by capacitor C5. The resulting D.C. voltage is output at node 30 and used to power the temperature control section of the circuit.

The oscillator loop operates as follows. At rest, without a voltage connected at terminals 10 and 12, field effect transistors Q3 and Q4 remain in a conductive state. When a thermopile or other voltage source is connected at terminals 10 and 12, current begins to flow through the transformer primary 18 and the FETS Q3 and Q4 to ground 22. Increasing the current flow into the dot side of the transformer primary winding 18 induces a voltage in the transformer secondary 20, which causes current to flow out of the dotted side of the secondary 20. Because the transformer has a high turns ratio (e.g., 50:1), the induced secondary voltage is high. When the secondary voltage is high enough, diode D5 becomes forward biased, and current flows from the transformer secondary 20 into capacitor C5. When the secondary voltage rises to the level of the zener diode 24 voltage plus the FET gate-source breakdown voltage, current begins to flow through the zener diode 24 and the FET gates to ground. Because the zener diode 24 and FET gate-source junctions break down at known voltages, the zener diode 24 can be selected to limit the voltage that appears on the capacitor C5. In this manner, the power supply circuit, 11 regulates the D.C. voltage output at node 30.

After current in the transformer primary 18 reaches a steady state, no energy will be transferred to the secondary 20. Energy then drains out of the transformer secondary 20 through diode D5 and zener diode 24 until the magnetic field induced in the transformer's core collapses. When the field collapses, the dotted side of the transformer secondary 20 swings very quickly to a negative voltage. During this brief negative voltage swing, diode D5 is reversed biased and does not conduct. Zener diode 24 becomes forward biased and draws the gate voltage of the FETs Q3 and Q4 negative enough to turn the FETS Q3 and Q4 off. When the FETs turn off, the steady state current in the transformer primary 18 is interrupted. The change to no current in the primary 18 briefly increases the negative voltage at the transformer secondary 20. The negative voltage increase causes zener diode 28 to conduct, thereby preventing the gate voltage on the FETS from dropping below the negative FET gate breakdown threshold. Although zener diode 28 is not necessary for the operation of the power supply, its presence protects and extends the life of FETS Q3 and Q4.

With no current in the primary 18 the voltage on the secondary 20 dissipates, and the FETS gates return to ground voltage. With their gates at ground, the FETs once again begin conducting, current flows in the primary 18, and the cycle starts over again. This cycle continues, each time allowing more current to flow into capacitor C5. Eventually, the voltage on capacitor C5 will rise to equal the zener diode 24 breakdown voltage of, for example, approximately 4–6.5 volts.

The direct current potential produced by the power supply circuit 11 is used to power the temperature control circuitry, including the microprocessor 34. The microprocessor 34 is programmed to periodically input a signal from the thermistor 54 to sample the cooking temperature, and to periodically input a signal from the set point input dial 66 to check the desired operating temperature. The microprocessor 34 sampling time is controlled by the clocking means 38, as previously described. The signal from the thermistor 54 varies as a function of the cooking temperature. In the preferred embodiment, the microprocessor 34 is programmed to sample a signal from the thermistor 54 several times per second, such as 10 times, and sample a signal from the set point input dial 66 less frequently, such as once every five seconds.

When the microprocessor 34 is sampling a signal from the thermistor 54, field effect transistor Q1 is conductive, and the temperature sensing circuit 46 and the internal A/D converter draw power from the supply 11. This creates a power drain on the supply 11, causing the capacitor C5 to begin discharging in order to meet the power requirements. After the signal from the thermistor 54 has been sampled, the microprocessor 34 discontinues the signal to the transistor Q1, thereby switching off the power to the temperature sensing portion 46 of the control circuit. The microprocessor also turns off the internal A/D converter. When switched off, the temperature sensing portion 46 and the internal A/D converter do not draw power from the power supply 11, and the capacitor C5 recharges.

Similarly, when the set point input dial 66 is sampled, there is a load drain on the power supply 11. During this drain, capacitor C5 begins to discharge. When the sampling cycle is complete, the capacitor C5 recharges.

After taking a temperature sample, the software in the microprocessor 34 uses a PID algorithm to compare the set point input dial signal with the temperature signal from the thermistor 54, to determine whether to turn on or off the fuel valve 78. If the software determines by use of the PID algorithm that heat is required, a signal is sent from pin 6 so that transistor Q2 is conductive, and the solenoid in the main fuel valve is energized. If the fuel valve is to be turned off, a signal is output from pin 6 to switch the transistor Q2 off, thereby deenergizing the solenoid. In this manner, the microprocessor 34 controls the amount of heat from the main burner (not shown) by continuously sampling the cooking oil temperature and comparing it to the desired operating temperature.

The microprocessor 34 is capable of functioning on a low voltage source, such as a thermopile, by switching off the power to the temperature sensing portion of the circuity when temperature is not being sampled. The load drain on the power supply 11 is high when the temperature sensing circuit 46 is powered on, but low when the temperature sensing circuit is powered off. Therefore, by turning the temperature sensing circuit power on and off through the field effect transistor Q1, the average power drain is an amount that can be met by the power supply 11.

While the circuit described constitutes a preferred embodiment of the invention, it is to be understood that the present invention is not limited to this precise form, and that variations may be made without departing from the scope of the invention.

What is claimed is:

1. A temperature control circuit comprising:

a direct current voltage source producing a direct current voltage insufficient to power a microprocessor, said voltage source being a thermopile heated by a flame and said direct current voltage produced by said thermopile being approximately 150 millivolts;

means for amplifying and storing said direct current voltage from said source to produce a regulated direct current potential, said amplifying means including, a transformer having a primary winding and a secondary winding, said primary winding being connected to said voltage source at a first end, said secondary winding being connected to a voltage regulating means, and a voltage controlled current switching means connected between said voltage regulating means and a second end of said primary winding, said voltage regulating means being a zener diode;

a micro-processor based temperature sensing circuit powered by said regulated direct current potential, said temperature sensing circuit including means for measuring a temperature and generating a temperature control signal corresponding to said measured temperature; and means for turning power to said temperature sensing circuit on and off in response to a signal from the microprocessor, said temperature sensing circuit being powered on when a temperature measurement is being taken and powered off when a temperature measurement is not being taken.

2. The circuit of claim 1, wherein said voltage controlled current switching means is at least two field effect transistors.

3. The circuit of claim 2, wherein said microprocessor includes an analog to digital converter that can be turned on and off, and said microprocessor is capable of operating on a low voltage power supply.

4. The circuit of claim 3, wherein said means for measuring a temperature is a thermistor in communication with said microprocessor.

5. The circuit of claim 4, wherein said means for turning power to said temperature sensing circuit on and off is a voltage controlled current switch connected to said microprocessor.

6. The circuit of claim 5, wherein said voltage controlled current switch is a field effect transistor.

7. A power supply circuit comprising:

a direct current voltage source;

a transformer having a primary winding magnetically coupled with a secondary winding;

a solid state current switching means connected in series with the primary winding and the voltage source, the solid state current switching means being at least two field effect transistors connected in parallel;

a voltage regulating means connected between the solid state current switching means and the secondary winding, the voltage regulating means being a zener diode; and means for rectifying and filtering a signal from the secondary winding of the transformer, said rectifying means connected to the voltage regulating means and the secondary winding.

8. The circuit of claim 7, wherein said voltage source is a thermopile.

9. The circuit of claim 8, wherein said thermopile is heated by a flame.

10. The circuit of claim 9, wherein said transformer has a turns ratio of 50:1.

11. A temperature control circuit comprising:

a direct current voltage source producing a direct current potential insufficient to power a microprocessor;

an oscillator connected to said voltage source, said oscillator including, a transformer having a first winding and a second winding, a voltage controlled switching means connected to said first winding of said transformer and to said voltage source, a voltage regulating means connecting said voltage controlled current switching means to said second winding of said transformer, means for rectifying a signal output from said transformer, said rectifying means connected to said second winding and said voltage regulating means, means for storing a regulated voltage output, and a common ground conductor means connecting said storing means, said second winding, said voltage source and said voltage controlled current switching means; and a temperature sensing circuit supplied by said regulated voltage output, said temperature sensing circuit including, a microprocessor, an analog circuit connected to said microprocessor, said analog circuit including a thermistor and means for amplifying a signal from said thermistor before it is input to said microprocessor, and a voltage controlled current switch connected between said microprocessor, said analog circuit, and said common ground conductor for periodically switching off power to said analog circuit in response to a signal from said microprocessor, said microprocessor sending a signal to said voltage controlled current switch between temperature measurements;

wherein said microprocessor generates a temperature control signal according to said temperature measurements;

said voltage controlled switching means is a pair of field effect transistors; and said voltage controlled current switch is a field effect transistor having a gate, a drain and a source, said drain being connected to said microprocessor, and said source being connected to said common ground conductor.

12. The circuit of claim 11, wherein said microprocessor included an analog to digital converter that can be turned on and off, and said microprocessor is capable of operating on a low voltage power supply.

* * * * *